United States Patent [19]

Usow

[11] Patent Number: 4,993,867

[45] Date of Patent: Feb. 19, 1991

[54] RIGID CONCRETE STAMPING TOOL WITH FLAT HANDLES

[76] Inventor: Allen D. Usow, 7600 SW. 171 St., Miami, Fla. 33157

[21] Appl. No.: 393,663

[22] Filed: Aug. 14, 1989

[51] Int. Cl.[5] ..... E01C 23/02

[52] U.S. Cl. ..... 404/89; 404/93

[58] Field of Search ..... 404/89, 93, 96, 97; D8/45; 249/15, 35; 425/469, 458

[56] References Cited

U.S. PATENT DOCUMENTS

| | | |
|---|---|---|
| D. 257,824 | 1/1981 | Puccini et al. . |
| D. 257,825 | 1/1981 | Puccini et al. . |
| D. 272,037 | 1/1984 | Puccini . |
| D. 282,623 | 2/1986 | Nasvik . |
| 1,096,445 | 5/1914 | McKesson . |
| 3,807,888 | 4/1974 | Bowman . |
| 3,887,293 | 6/1975 | Bowman . |
| 3,887,294 | 6/1975 | Leon . |
| 3,910,711 | 10/1975 | Moorhead . |
| 3,930,740 | 1/1976 | Bowman . |
| 4,105,354 | 8/1978 | Bowman . |
| 4,128,357 | 12/1978 | Barth et al. . |
| 4,131,406 | 12/1978 | Fresquez . |
| 4,135,840 | 1/1979 | Puccini et al. . |
| 4,231,677 | 11/1980 | Roming . |
| 4,523,873 | 6/1985 | Elliot . |
| 4,776,723 | 10/1988 | Brimo . |
| 4,828,426 | 5/1989 | Hendricks et al. ..... 404/89 X |

FOREIGN PATENT DOCUMENTS

| | | |
|---|---|---|
| 2176826 | 1/1987 | United Kingdom . |

OTHER PUBLICATIONS

'Brickform Tools' Brochures, Rafco Products, undated but product is prior art.

Catalog pages from GoldBlatt tools catalog, 1988 pp. 20 and 21.

*Primary Examiner*—William P. Neuder

*Attorney, Agent, or Firm*—Jerry A. Miller

[57] ABSTRACT

An improved concrete stamping tool is rigid in construction made of a high impact plastic. It has a lower blade assembly molded to a substantially flat upper assembly haivng flat handles on an upper surface thereof. A handle mount is provided in the center of the tool and a array of holes allows ganging of a plurality of such tools in either the vertical or horizontal direction.

8 Claims, 4 Drawing Sheets

RIGID CONCRETE STAMPING TOOL WITH FLAT HANDLES

BACKGROUND

1. Field of the Invention

This invention relates generally to the field of concrete stamping tools for imprinting patterns on the surface of concrete. More particularly, this invention relates to rigid concrete stamping tools having flat handles.

2. Background of the Invention

The process of concrete stamping is used to produce a simulated surface resembling that of, for example brick, tile or stone, to provide a durable simulation of these materials. The process is carried out by first pouring concrete and floating out the poured concrete. Next the surface of the mixture may be colored with various concrete color hardeners such as those manufactured by Andrite (Andrite is a registered trademark). Then a concrete stamping tool (sometimes called an embossing tool or impressing tool) is pressed into the surface of the concrete to create various cuts and three dimensional patterns in the surface of the concrete. When the concrete cures, the embossed surface resembles that of another material. For example, the embossed concrete surface closely resembles laid brick, tile or stone. When the process is performed skillfully, only very close inspection will reveal otherwise. Many configurations and designs for such tools have been implemented using various configurations, material selections, handle arrangements and the like. The following United States patents are illustrative of the state of the art in such tools:

1,096,445—McKesson,
3,832,079—Moorhead,
3,807,888—Bowman,
3,887,293—Bowman,
3,887,294—Leon,
3,910,711—Moorhead,
3,930,740—Bowman,
4,105,354—Bowman,
4,128,357—Barth et al,
4,131,406—Fresquez,
4,135,840—Puccini et al,
4,176,848—Lafuze,
4,523,873—Elliot,
4,231,677—Roming,
4,776,723—Brimo,
DES 257,824—Puccini et al,
DES 257,825—Puccini et al,
DES 272,037—Puccini,
DES 282,623—Nasvic.

Also of interest is U.K. patent application Ser. No. 2,176,826.

Of these patents, the Roming, Fresquez and Brimo patents show use of a handle adapter for attaching a length of pipe or the like to form a handle. In general, each of the smaller manually operated devices operates in conjunction with other similar stamping tools by various interlocking mechanisms or by simply placing one tool along side the other in alignment to progressively imprint adjacent areas of concrete. Several of the devices such as the Brimo patent and the U.K. application, use strap-like handles to facilitate movement and application of the tool.

The commercially available 'Brickform tools' supplied by Goldblatt Tool Company, Kansas City, Kans.

and described in the product literature entitled "BRICKFORM TOOLS" are a substantial improvement over many of the rigid tools described in the above references. These tools are made of molded plastic which is able to withstand a substantial amount of punishment in use where they are frequently struck with hammers and other heavy objects, walked upon and carried in substantial numbers to and from work sites.

The Brickform tools use an integral molded handle to facilitate carrying. They are light in weight due to the material selection and have high impact resistance. Unfortunately, the Brickform tools have several substantial disadvantages. The integral handles make it difficult to walk on the tools to add weight needed to imprint the concrete and present a tripping hazard to those walking on them. They cannot be effectively ganged in all directions to reduce labor. They do not stack well making transport and storage difficult and they do not accept a pipe handle.

Other commercially available tools, such as those available from GoldBlatt Tool Company provide a mechanism for ganging but cannot be ganged in all directions.

The present invention ameliorates these problems in an improved molded stamping tool.

SUMMARY OF THE INVENTION

It is an object of the present invention to provide an improved rigid concrete stamping tool.

It is a further object of the present invention to provide a concrete stamping tool which may be compactly stored or packaged.

It is another object of the present invention to provide a rigid concrete stamping tool which may be readily ganged either vertically or horizontally.

It is a further object of the present invention to provide a concrete stamping tool which has a substantially level upper surface so that the tools stack easily and are easy to walk on while simultaneously providing handles for ease of handling.

It is an advantage of the invention that it is light in weight, high in impact strength and easily worked.

These and other objects and advantages of the invention will become apparent to those skilled in the art upon consideration of the following description of the invention.

In one embodiment of the present invention, an improved concrete stamping tool is rigid in construction made of a high impact plastic. It has a lower blade assembly molded to a substantially flat upper assembly having flat handles on an upper surface thereof. A handle mount is provided in the center of the tool and an array of holes allows ganging of a plurality of such tools in either the vertical or horizontal direction.

An improved rigid concrete stamping tool includes an upper support structure having an upper and a lower surface, two ends and two sides. A lower blade assembly has an upper surface connected to the lower surface of the upper support structure. A handle is coupled to the upper surface of the upper support structure, the handle being substantially flush with the upper surface of the upper support structure. A coupler is situated on the upper support structure, for permitting attachment of ganging planks to gang together a plurality of similar rigid concrete stamping tools in either a side to side configuration or an end to end configuration so that the handles do not interfere with ganging planks in either the side to side or end to end configurations.

An improved rigid concrete stamping tool includes an upper support structure having a grid-like configuration with an upper and a lower surface, two ends and two sides. A lower blade assembly has an upper surface connected to the lower surface of the upper support structure. A handle is coupled to the upper surface of the upper support structure, the handle being substantially flush with the upper surface of the upper support structure. A pipe flange is bolted to the upper support structure with a pipe threaded into the pipe flange. A coupler is situated on the upper support structure, for permitting attachment of ganging planks to gang together a plurality of similar rigid concrete stamping tools in either a side to side configuration or an end to end configuration so that the handles do not interfere with ganging planks in either the side to side or end to end configurations. A connector for mounting a pipe handle in a central area of the upper support structure is provided. Preferably, the concrete stamping tool is molded from a polymer made up of approximately 15% air.

A ganged arrangement of rigid concrete stamping tools includes a first rigid concrete stamping tool having substantially flush handles mounted to an upper surface thereof. A second rigid concrete stamping tool similarly has substantially flush handles mounted to an upper surface thereof. A ganging plank is adjacent the upper surfaces of the first and second rigid concrete stamping tools and covers a portion of each of the substantially flush handles.

The features of the invention believed to be novel are set forth with particularity in the appended claims. The invention itself, however, both as to organization and method of operation, together with further objects and advantages thereof, may be best understood by reference to the following description taken in conjunction with the accompanying drawing.

DETAILED DESCRIPTION OF THE INVENTION

Figure 1:
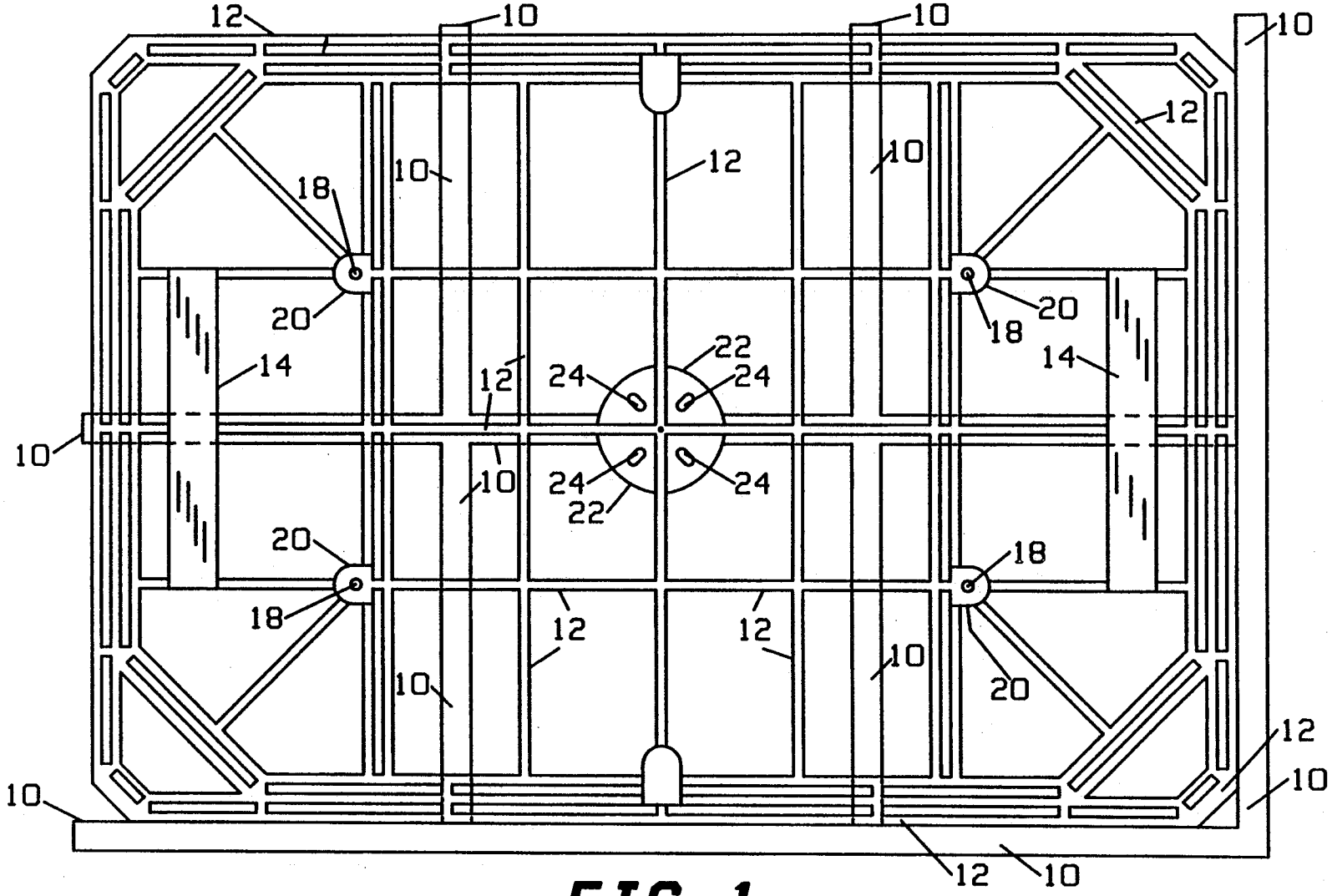
FIG. 1 shows a top view of a concrete stamping tool according to the present invention.
Figure 2:
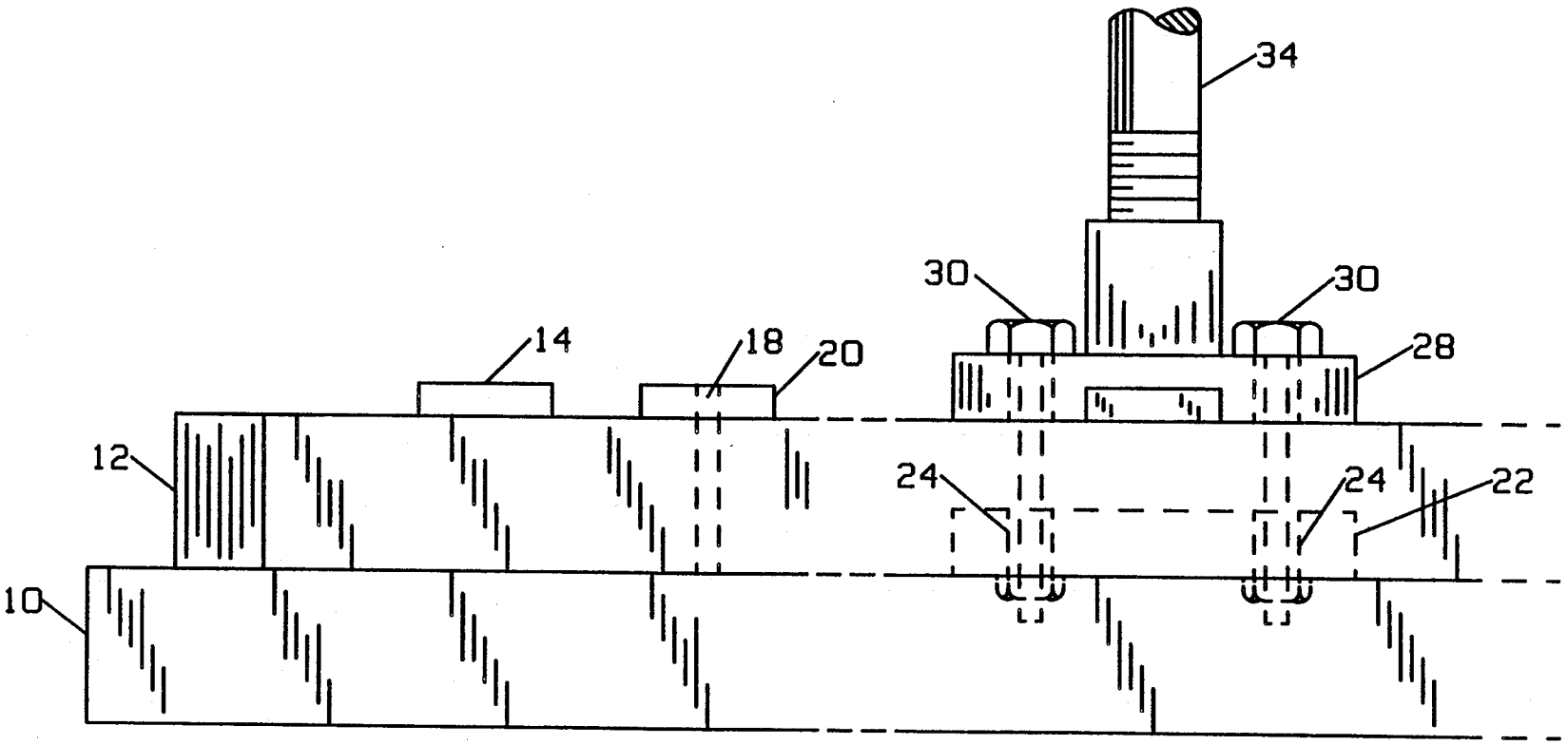
FIG. 2 shows a side view of the concrete stamping tool of the present invention showing the elevations of the various parts a pipe handle installed.

Turning now to the drawing in which like reference numerals designate corresponding parts throughout the several figures thereof, and in particular to FIG. 1 viewed simultaneously with FIG. 2, a top view and a side view respectively of a concrete stamping tool according to the present invention is shown. Tools according to this invention are commercially available from Andrite, 11300 SW 208 Drive, Miami, Fla. 33189 and are described in the following publications available from Andrite which are incorporated by reference: "Everything Needed to Install Stamped Concrete Without Franchise Fees!"; Andrite Stamped Concrete Products brochure; and "Installation Instructions for Andrite Stamped Concrete", January 1989.

FIG. 1 shows a concrete stamping tool according to this invention which has a lower blade assembly 10 which may take on various patterns in a known manner to provide the imprinting action on uncured concrete. The pattern shown in FIG. 1 is a rectangular pattern having three blade members in one direction and two other intersecting blade members disposed 90 degree angle, but this is not to be limiting. This lower blade assembly 10 is integrally molded to an upper support assembly 12 which, in the preferred embodiment, is fashioned into a grid-like structure to provide strength and stability while simultaneously minimizing the amount of material needed. By so minimizing the amount of material needed, the weight is kept to a minimum as well as the cost. Each of the solid elements of the grid are approximately ¼ inch wide and 1 inch thick and this has been found to provide adequate strength with low weight and cost.

Preferably the grid of support assembly 12 is designed so that the maximum significant opening in the upper surface thereof is no more than about 3¼ inches in any direction (vertical or horizontal) so as to facilitate easy walking on the surface. Disposed on the upper surface are several significant structures. A handle 14 is provided near each end of the tool to facilitate handling the tool. These handles 14 are simply rectangular strips molded across several sections of grid on the upper surface to provide a place to easily grip the tool. While the handle protrudes above the upper surface of the support structure, it only does so by about ¼ inch so that it is very acceptably easy to walk on as well as providing no significant impediment to stacking. In other embodiments, the handle may be molded flush with the upper surface with an opening recessed into the upper support structure 12 without departing from the present invention. In either case, the top of the handle may be considered to be substantially flush with the surface since it protrudes only a very small amount which will not hinder walking on the surface or ganging as will be described later.

Also provided on the upper support structure is an array of bolt holes 18 molded or drilled into a corresponding array of solid areas 20 to provide a place to attach boards or other structures to allow for ganging several similar tools together as will be described later. Note that the solid areas are at the same height as the handles so that the handles do not interfere with ganging from any direction. Also note that the ganging holes and solid areas are situated adjacent the diagonal portions of the grid to provide added strength in this area.

In the center of the tool, a handle mount 22 is provided which is essentially an area of the tool which has additional material provided (in this case in a circular pattern) and in which several holes 24 are formed. This configuration allows a conventional pipe flange 28 to be bolted to the tool through the holes in such a flange and holes 24 using ordinary bolts 30. A length of pipe 34 can then be screwed into the pipe flange to provide a handle if desired.

Figure 3:
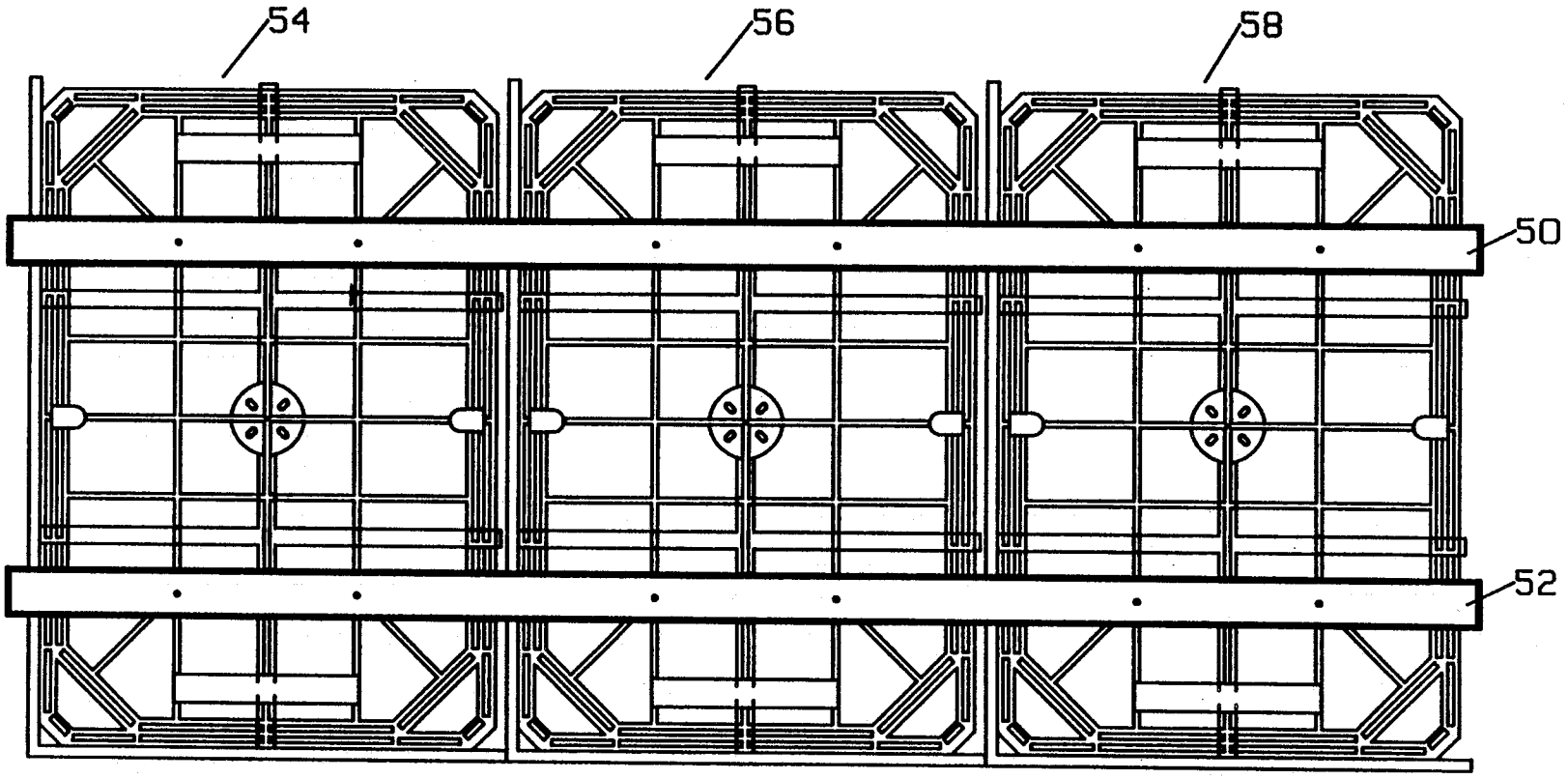
FIG. 3 shows a top view of several of the tools of the present invention ganged together in a side to side configuration.

Turning now to FIG. 3, an arrangement for ganging several (in this example three) tools according to the present invention is shown. In this drawing, a pair of boards 50 and 52, such as simple 2×4 studs, are simply bolted in place through holes corresponding to holes 18 of the tools 54, 56 and 58 respectively, which are positioned in a side to side arrangement, to provide what amounts to a single larger tool to facilitate uniform treatment of the uncured concrete.

Figure 4:
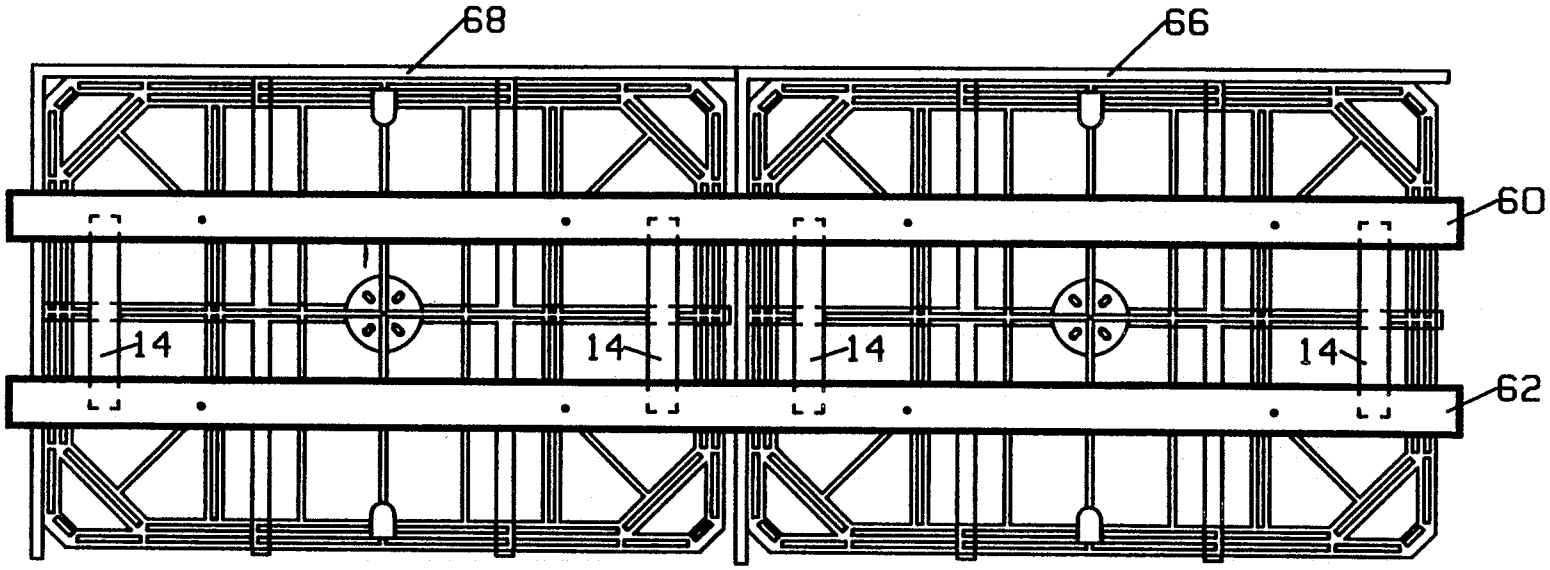
FIG. 4 shows a top view of several of the tools of the present invention ganged together in an end to end configuration.

Turning now to FIG. 4, an arrangement for ganging the tools in the other direction is shown. In this arrangement, a similar pair of wooden (or other suitable material) planks 60 and 62, such as 2×4 studs, are again bolted to tools 66 and 68 with the tools oriented end to end. In this arrangement, the handles 14 of each of tools 66 and 68 are partially covered by the planks 60 and 62. Since the solid areas 20 are at the same height as the tool's handles, there is no obstacle to bolting the tools together.

When used ganged together as described above, the planks can be struck rather than the tools to provide even distribution of the force while minimizing wear of the tool. When the wooden planks become severely worn, they are simply and economically replaced. In addition to the speed improvement when ganging such tools, the uniformity of depth of impression of the concrete is also improved.

In the preferred embodiment, the tools are made of a structural foam material which is injection molded, but this is not to be limiting. The preferred material is made of approximately 15% air such as ABS structural foam which is readily commercially available. Similar polymer materials are suitable. This material provides uniformity of impact as well as the other properties previously discussed. Similar tools can be fabricated using other materials such as aluminum with acceptable results if desired.

Thus it is apparent that in accordance with the present invention, an improved apparatus and method that fully satisfies the objectives, aims and advantages is set forth above. While the invention has been described in conjunction with specific embodiments, it is evident that many alternatives, variations, modifications and permutations will become apparent to those skilled in the art in light of the foregoing description. Accordingly, it is intended that the present invention embrace all such alternatives, variations, modifications and permutations as fall within the spirit and broad scope of the appended claims.

What is claimed as new and desired to be secured by Letters Patent is:

1. An improved rigid concrete stamping tool, comprising in combination:

an upper support structure having an upper and a lower surface, two ends and two sides;

a lower blade assembly having an upper surface connected to the lower surface of said upper support structure;

a handle coupled to said upper surface of said upper support structure, said handle being substantially flush with said upper surface of said upper support structure; and coupling means, situated on said upper support structure, for permitting attachment of ganging planks to gang together a plurality of similar rigid concrete stamping tools in either a side to side configuration or an end to end configuration;

at least one ganging plank coupled to said coupling means, said ganging plank overlying said handles; whereby said handles do not interfere with ganging planks in either said side to side or end to end configurations.

2. The apparatus of claim 1, further comprising means for mounting a pipe handle in a central area of said upper support structure.

3. The apparatus of claim 1, wherein said concrete stamping tool is molded from a polymer made up of approximately 15% air.

4. The apparatus of claim 1, wherein said upper support structure comprises a support grid.

5. The apparatus of claim 1, further comprising a pipe flange bolted to said upper support structure and a pipe threaded into said pipe flange.

6. The apparatus of claim 1, further comprising:

a second concrete stamping tool having structure substantially identical to said concrete stamping tool; and a pair of said ganging planks bolted to said tools to provide a pair of end to end ganged tools for simultaneously stamping twice the concrete area which could be stamped by a single such tool, said planks overlying said handles of said tools.

7. An improved rigid concrete stamping tool, comprising in combination:

an upper support structure having a grid-like configuration with an upper and a lower surface, two ends and two sides;

a lower blade assembly having an upper surface connected to the lower surface of said upper support structure;

a handle coupled to said upper surface of said upper support structure, said handle being substantially flush with said upper surface of said upper support structure;

a pipe flange bolted to said upper support structure with a pipe threaded into said pipe flange;

coupling means, situated on said upper support structure, for permitting attachment of ganging planks to gang together a plurality of similar rigid concrete stamping tools in either a side to side configuration or an end to end configuration;

at least one ganging plank coupled to said coupling means, said ganging plank overlying said handles; whereby, said handles do not interfere with ganging planks in either said side to side or end to end configuration means for mounting a pipe handle in a central area of said upper support structure; and wherein said concrete stamping tool is molded from a polymer made up of approximately 15% air.

8. A ganged arrangement of rigid concrete stamping tools, comprising in combination:

a first rigid concrete stamping tool having substantially flush handles mounted to an upper surface thereof;

a second rigid concrete stamping tool having substantially flush handles mounted to an upper surface thereof; and a ganging plank adjacent said upper surfaces of said first and second rigid concrete stamping tools, said ganging plank overlying and covering a portion of each of said substantially flush handles.

* * * * *